US005385609A

United States Patent [19]

Rose et al.

[11] Patent Number: 5,385,609

[45] Date of Patent: Jan. 31, 1995

[54] APPARATUS AND METHOD FOR TREATING THE OUTER SURFACE OF A PIPELINE

[75] Inventors: James L. Rose; Samuel J. Homes, both of Houston, Tex.

[73] Assignee: E. B. Thomas, Houston, Tex.

[21] Appl. No.: 874,646

[22] Filed: Apr. 27, 1992

Related U.S. Application Data

[63] Continuation-in-part of Ser. No. 646,499, Jan. 28, 1991, Pat. No. 5,107,633, which is a continuation-in-part of Ser. No. 470,819, Jan. 26, 1990, abandoned.

[51] Int. Cl.[6] ..... B24C 3/06

[52] U.S. Cl. ..... 118/119; 451/75; 134/180; 134/181

[58] Field of Search ..... 51/410, 420, 424, 425, 51/426, 428, 429, 439; 134/180, 181

[56] References Cited

U.S. PATENT DOCUMENTS

| | | | |
|---|---|---|---|
| 1,815,573 | 7/1931 | McManis | 15/104.04 |
| 1,821,352 | 9/1931 | McManis | 29/81.02 |
| 1,910,497 | 7/1931 | Peik | 51/426 |
| 2,302,196 | 11/1941 | Downs et al. | 15/104.04 |
| 2,460,989 | 2/1949 | Kraner | 51/426 |
| 2,500,459 | 3/1950 | Hoover et al. | 294/82.16 |
| 2,621,446 | 12/1952 | Russell | 51/424 X |
| 2,945,677 | 7/1960 | Kammerer, Jr. | 294/82.16 |
| 3,037,803 | 6/1962 | Phillips | 294/82.16 |
| 3,362,109 | 1/1968 | Wallace | 51/424 |
| 4,205,694 | 6/1980 | Thompson et al. | 134/181 |
| 4,552,594 | 11/1985 | van Voskuilen et al. | 134/34 |
| 4,603,516 | 8/1986 | Hoffman | 51/425 |
| 4,677,998 | 7/1987 | van Voskuilen et al. | 134/181 |
| 4,724,970 | 2/1988 | Kühn | 294/82.16 |
| 4,953,496 | 9/1990 | Taylor et al. | 51/429 X |
| 5,069,234 | 12/1991 | Nielsen | 51/429 X |
| 5,092,357 | 3/1992 | Chapman et al. | 134/181 |

FOREIGN PATENT DOCUMENTS

| | | |
|---|---|---|
| 0214841 | 3/1987 | European Pat. Off. . |
| 0343878 | 11/1989 | European Pat. Off. . |

*Primary Examiner*—Jack W. Lavinder

*Attorney, Agent, or Firm*—Bush, Moseley, Riddle & Jackson

[57] ABSTRACT

A carriage (28–28B) has rollers (58–58B) supported on the outer surface of a pipeline (10) for movement therealong in the cleaning operation for the pipeline. A nozzle assembly (86–86B) is mounted for oscillating movement relative to a supporting frame in a direction concentric to the outer peripheral surface (58) of the pipeline (10) with fluid discharge nozzles (104–104B) mounted on the nozzle assembly for discharge of pressurized fluid against the surface of the pipeline (10). In one embodiment (FIGS. 2–7) an enclosed cylindrical nozzle assembly (68) has rollers (96) thereon mounted on an outer fixed cylindrical housing for oscillating movement. In other embodiments (FIGS. 8–10 and FIGS. 11–12) fixed U-shaped yokes (61A, 61B) are positioned alongside pipeline (10) and support the nozzle assembly (68A, 68B) for oscillation.

12 Claims, 7 Drawing Sheets

FIG.1
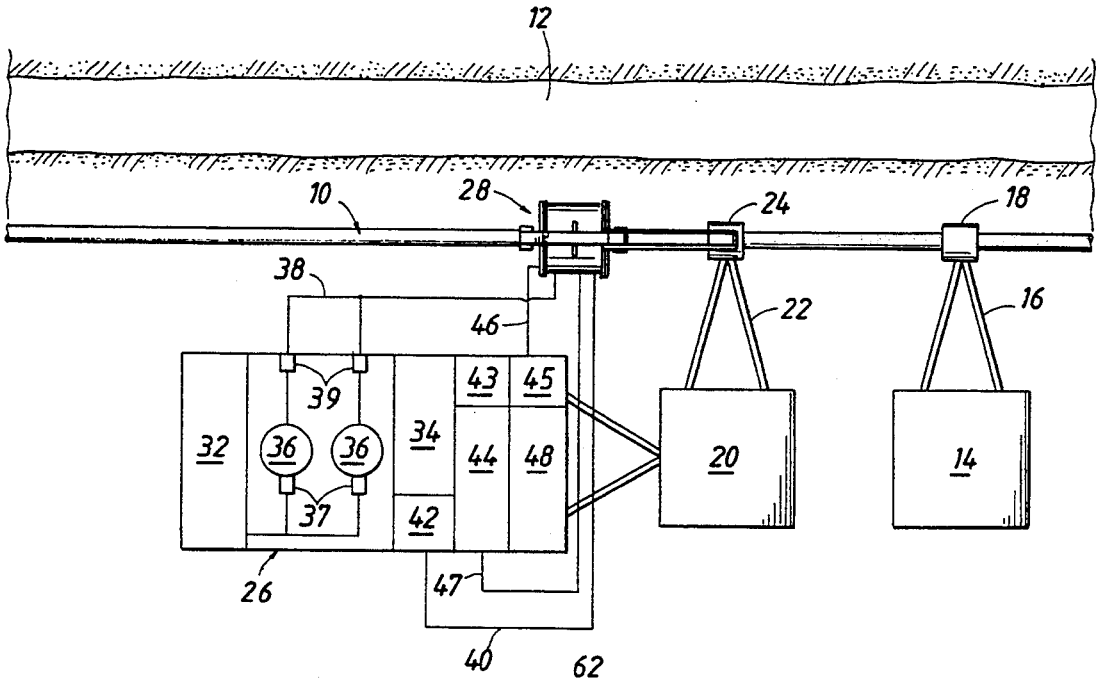
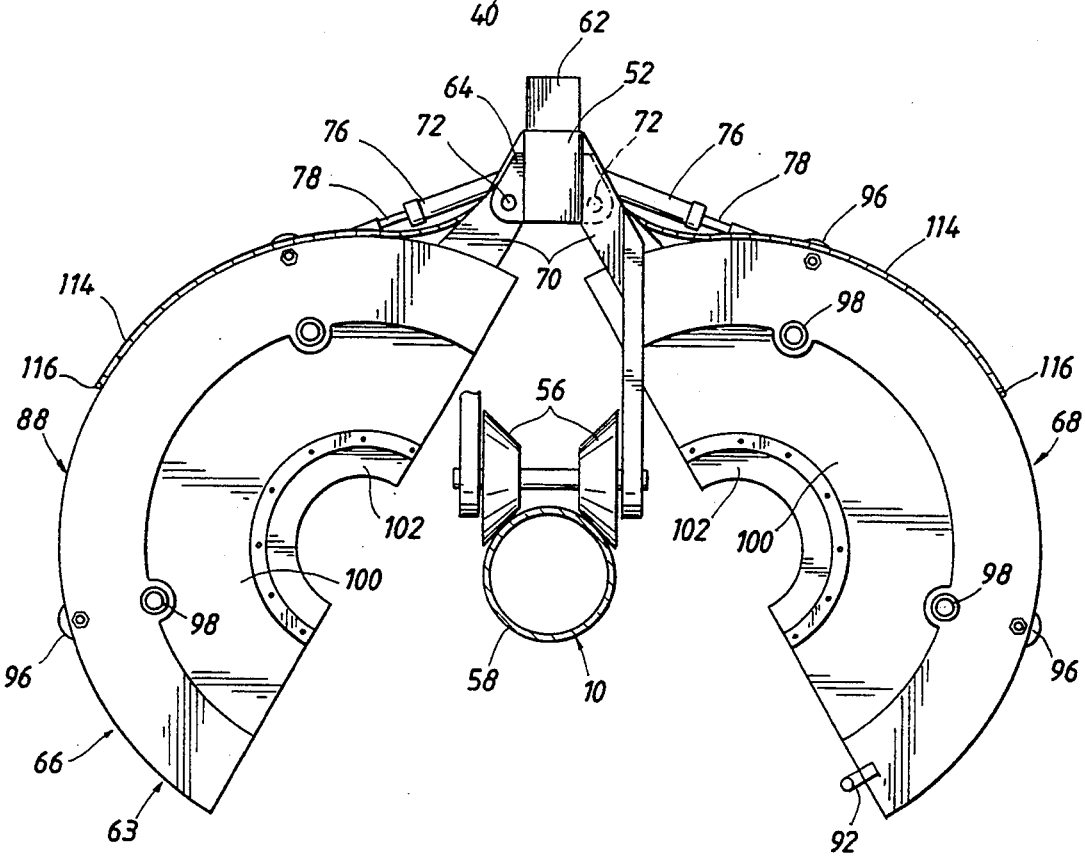
FIG.4

FIG. 5
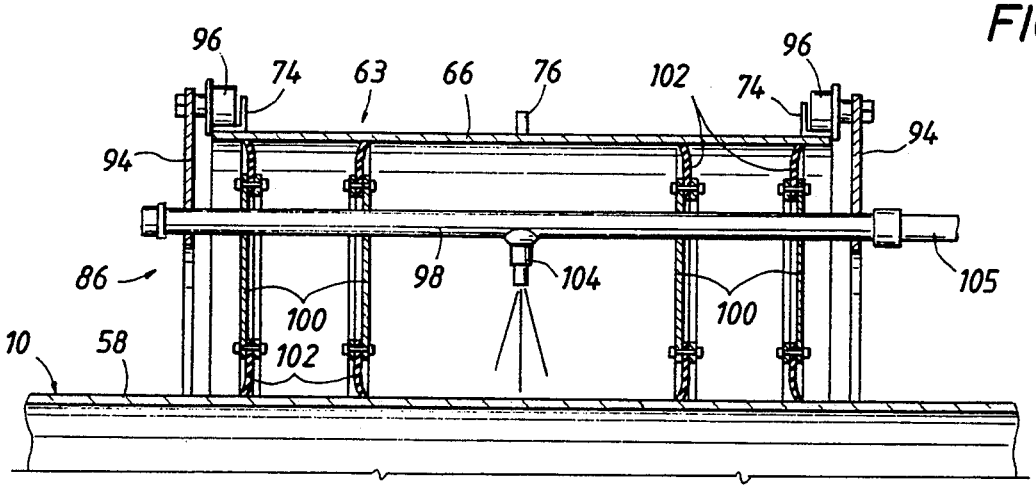
FIG. 6
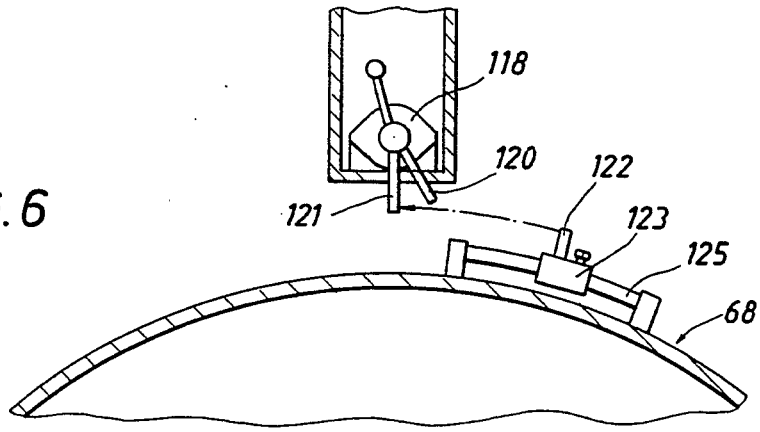
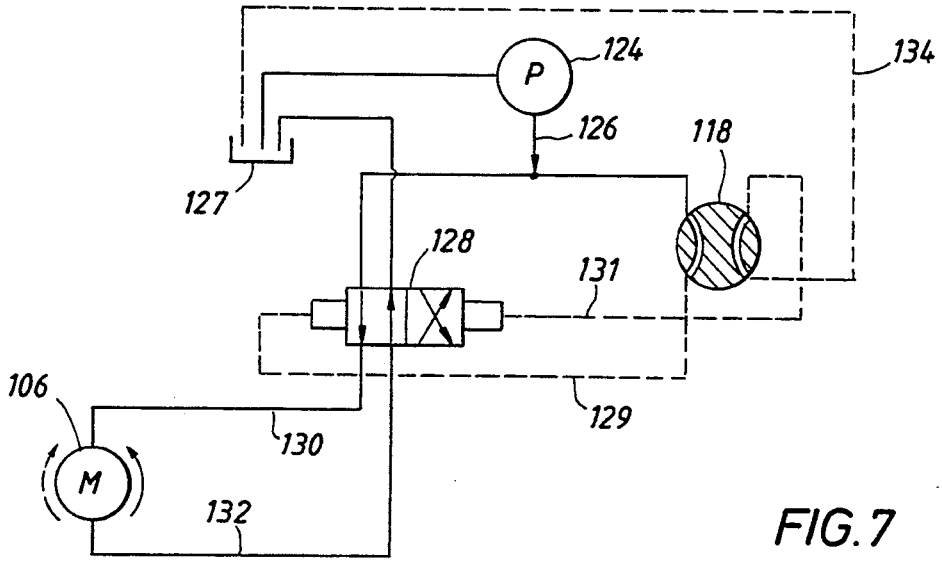
FIG. 7

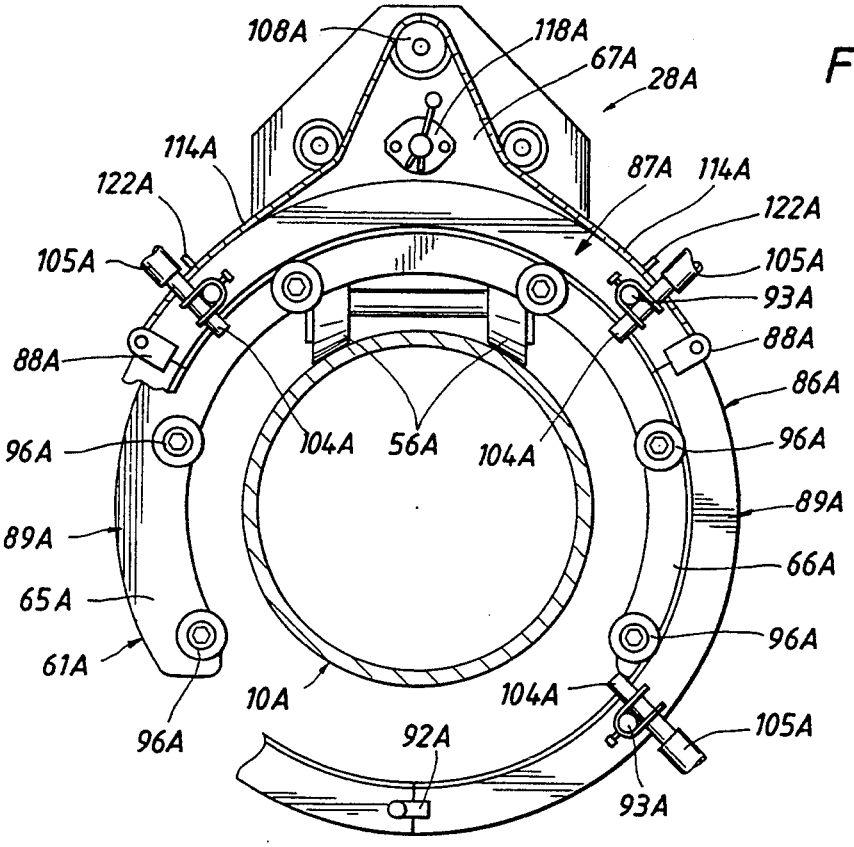
FIG. 8
FIG. 10
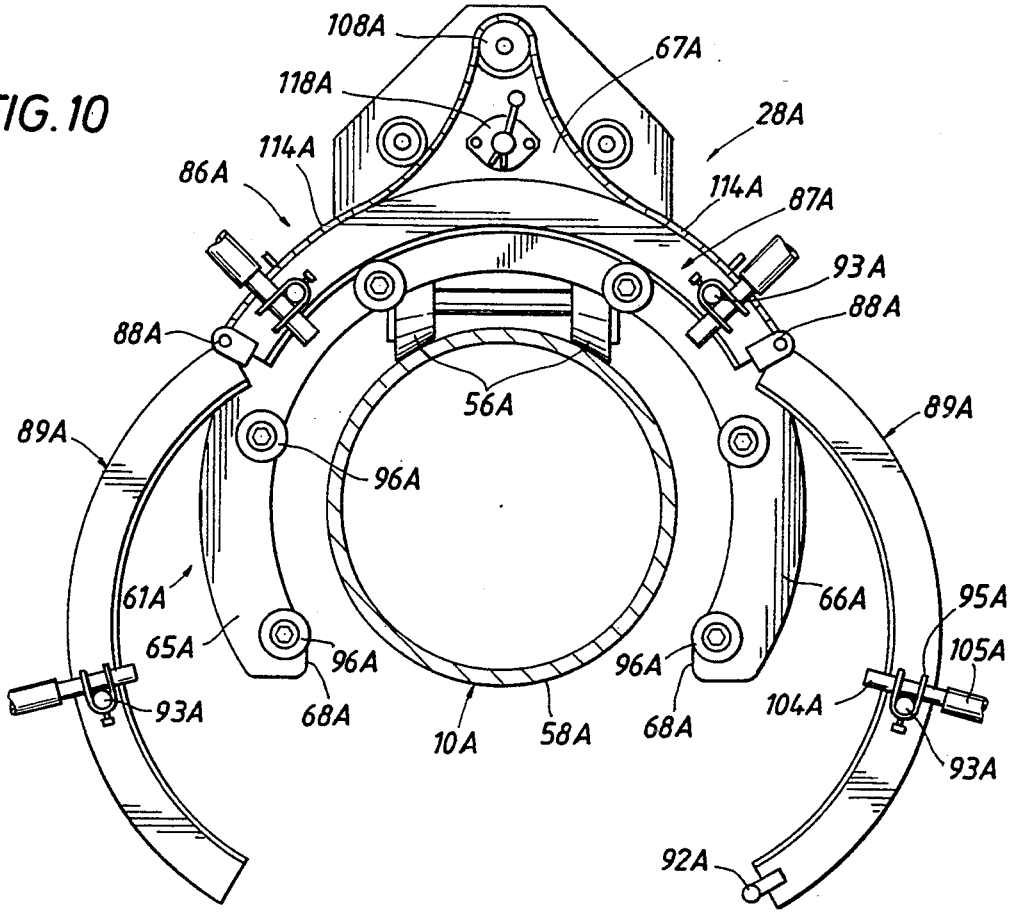

APPARATUS AND METHOD FOR TREATING THE OUTER SURFACE OF A PIPELINE

REFERENCE TO RELATED APPLICATIONS

This application is a continuation-in-part of pending application Ser. No. 646,499 filed Jan. 28, 1991 now U.S. Pat. No. 5,107,633; which is a continuation-in-part of application Ser. No. 470,819 filed Jan. 26, 1990, abandoned.

FIELD OF THE INVENTION

This invention relates to the apparatus and method for treating the outer surface of a pipeline, and more particularly to such a method and apparatus for treating the outer surface of the pipeline as the apparatus moves along the pipeline.

BACKGROUND OF THE INVENTION

Heretofore, self propelled apparatus has been provided, such as shown in U.S. Pat. No. 4,603,516 for treating the outer surface of a pipeline or pipe as the apparatus moves along a pipeline while supported thereon. Treating the outer surface of the pipeline such as by cleaning removes loose rust, scale and dirt, to prepare the pipe for the subsequent application of a coating material on the outer surface of the pipeline to minimize corrosion and prolong the service life of the pipeline. In some instances, the pipeline may be wrapped with an outer lining material containing an inner coating material for contacting the outer cleaned surface of the pipeline. Abrasive particles, such as hard shot particles or grit, have been thrown by centrifugal force from an impeller wheel or the like against the outer surface of the pipeline for cleaning the pipe. Particularly where hard shot particles of a uniform size have been used a relatively smooth clean outer surface has been obtained on the pipeline.

It is desirable to have a roughness on the outer surface of the pipeline to provide a strong bond between the pipeline and coating. The roughness increases the surface area of the pipe in contact with the coating for "anchoring" the coating on the pipeline. Such an increased area bond is particularly needed upon an expansion of the pipeline resulting from pressure or temperature increases to maintain the bonding contact between the pipeline and coating. The greater the roughness, the stronger the bond between the pipeline and coating particularly for shearing stresses. An enclosed blast chamber or housing on a self propelled carriage travelling along the pipeline has been utilized previously but such carriages have been relatively complex for carrying blast wheels or impellers and for assembly on and disassembly off the pipeline.

It is desired under certain conditions to have cleaning nozzles which move in an arcuate path concentric to the pipe so that the nozzles maintain a constant radial distance from the outer surface of the pipeline during the cleaning operation. In this manner the velocity of the fluid and entrained particles striking the outer surface of the pipeline is generally uniform since a constant distance form the pipe is maintained. U.S. Pat. No. 4,953,496 dated Sep. 4, 1990 provides a cleaning apparatus in which wheeled nozzle carriages are mounted for arcuate movement along arcuate rings which are secured to mounted arms. The nozzle carriages are engaged by chains for oscillating movement relative to the arcuate rings with the nozzles maintaining a constant radial distance from the outer surface of the pipe. Thus, a relatively complex mounting is provided in the '496 patent in order to oscillate the nozzle carriages along an arcuate path relative to the arcuate rings.

SUMMARY OF THE PRESENT INVENTION

Copending application Ser. No. 646,499 shows an embodiment in FIGS. 8–10 in which a wheeled support carriage mounted on a pipeline for movement therealong supports an enclosed housing having fluid discharge nozzles thereon with the enclosed housing mounted for oscillation along an arcuate path concentric to the outer periphery of the pipeline and relative to the support carriage. The nozzles are fixed to the enclosed housing and move with the housing in an arcuate path concentric to the outer periphery of the pipeline. The nozzles direct the pressurized fluid and entrained particles toward the center of the pipeline and maintain a constant distance from the outer surface of the pipeline during the cleaning operation thereby to provide a generally uniform striking velocity against the pipe and a uniform cleaning action.

The present invention is directed to an apparatus and method for treating or cleaning a pipeline utilizing a carriage mounted on the pipeline for movement along the pipeline and supporting a plurality of nozzles mounted for relative movement in an arcuate path concentric to the outer surface of the pipeline. One embodiment of this invention comprises a wheeled support frame including an outer cylindrical housing for fitting about the pipeline and an inner nozzle assembly received within the outer cylindrical housing for relative arcuate movement concentric to the outer periphery of the pipeline. The inner nozzle assembly has outer rollers supported on the cylindrical housing for oscillating movement of the inner nozzle assembly in an arcuate path. The inner nozzle assembly includes a plurality of annular parallel plates mounted within the outer cylindrical housing and supporting a plurality of arcuately spaced tubular members conduit for discharge nozzles. The discharge nozzles are directed toward the center of the pipeline and maintain a uniform distance or spacing from the outer surface of the pipeline during the cleaning operation.

In another embodiment the carriage includes a wheeled support frame including a fixed yoke positioned along opposed sides of the pipeline and supporting a nozzle assembly for oscillation along an arcuate path concentric to the outer periphery of the pipeline. Discharge nozzles fixed to the nozzle assembly move in an arcuate path concentric to the outer surface of the pipeline to maintain a uniform spacing from the outer surface of the pipeline during the cleaning operation.

It is desirable under certain conditions to clean and coat a pipeline while the pipeline remains in service for the transport of fluid ladings. Under these conditions, the pipeline remains in place in the ditch and wooden supports are placed under the pipeline with the soil or material adjacent the pipeline removed to receive the wooden support. The cleaning apparatus is positioned about the pipeline while the pipeline is supported between spaced wooden supports and moves along the pipeline between the wooden supports. As stressing of the pipeline may occur from the weight of the cleaning apparatus, it is desirable to mount the cleaning apparatus about the pipeline in a cushioned manner to offset the weight of the apparatus on the pipeline. For this purpose, a side boom tractor alongside the ditch has a boom mounting a lift hook on a cushioned pulley and cable arrangement connected to the lift hook for supporting the cleaning apparatus for movement along the pipeline. The pulley and cable arrangement supporting the lift hook is cushioned by a variable rate air spring mounted on the boom thereby to provide shock absorbing means.

It is an object of this invention to provide an apparatus and method for treating the outer surface of a pipeline including discharge nozzles mounted for oscillation along an arcuate path concentric to the outer surface of the pipeline.

It is a further object of this invention to provide such an apparatus and method in which the upper wheeled support frame is lowered alongside the pipeline without any pivoting or gripping movement and supports the nozzle assembly for arcuate movement concentric to the outer periphery of the pipeline.

It is another object of this invention to provide such an apparatus and method in which an inner nozzle assembly is supported on an outer fixed cylindrical housing and oscillates in an arcuate movement concentric to the outer periphery of the pipeline.

It is an additional object of this invention to provide a pipe treating apparatus supported on a pipeline while in service with the weight of the apparatus on the pipeline being offset.

Other objects, features, and advantages of this invention will become more apparent after referring to the following specification and drawings.

BRIEF DESCRIPTION OF THE DRAWINGS

FIG. 1 is a schematic of the apparatus of the present invention for cleaning the outer surface of a pipeline including a carriage travelling along the pipe and having discharge nozzles thereon mounted for oscillating movement in an arcuate path concentric to the outer surface of the pipeline;

FIG. 4 is an end elevation similar to FIG. 3 but showing the outer housing and inner nozzle assembly pivoted to an open position for assembly and disassembly from the pipeline;

FIG. 5 is an enlarged section taken generally along line 5—5 of FIG. 3 and showing the inner nozzle assembly mounted on the fixed outer cylindrical housing;

FIG. 6 is an enlarged partial elevation of the drive means for oscillating the nozzle assembly in an arcuate path;

FIG. 7 is a schematic of the hydraulic fluid system including a reversing fluid motor for oscillating the nozzle assembly relative to the outer cylindrical housing;

FIG. 8 is a side elevation of another embodiment of the apparatus of this invention in which an upper wheeled support frame has a U-shaped yoke fitting alongside the pipeline and supporting a nozzle assembly for movement in an arcuate path concentric to the outer periphery of the pipeline;

FIG. 10 is an end elevation of the apparatus similar to FIG. 8 but showing the nozzle assembly pivoted to an open position for assembly on and disassembly from the pipeline;

DESCRIPTION OF THE INVENTION

Figure 3:
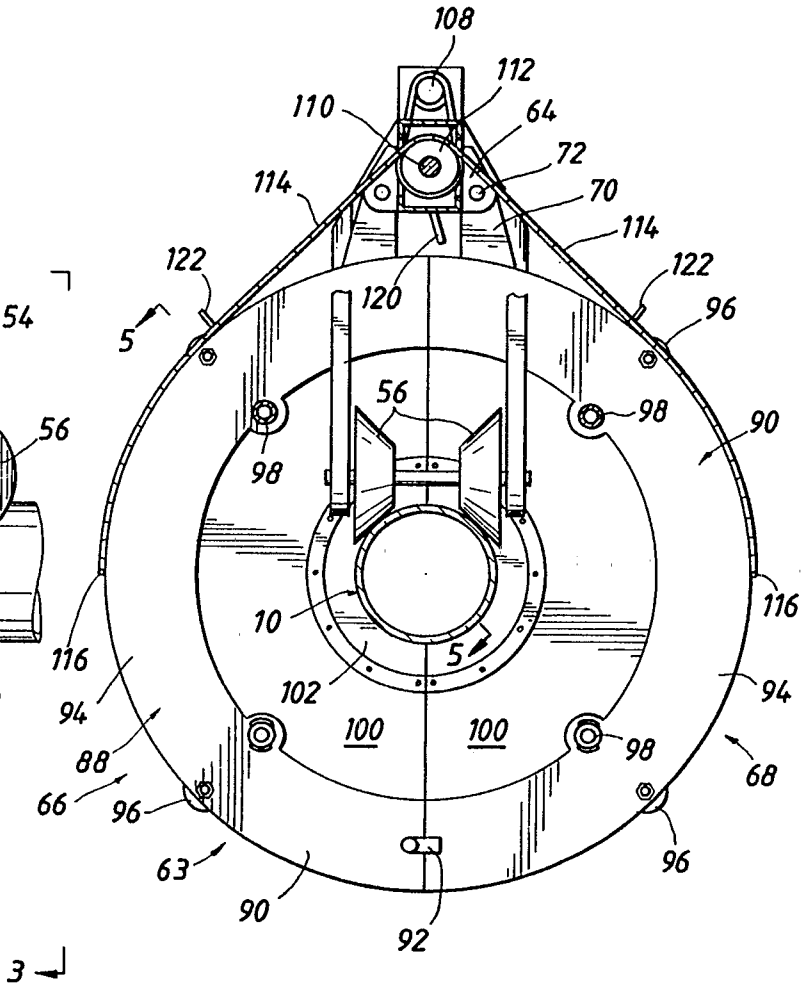
FIG. 3 is an end elevation taken generally along 3—3 of FIG. 2 and showing the apparatus in position about the pipeline for travelling along the pipe.
Figure 2:
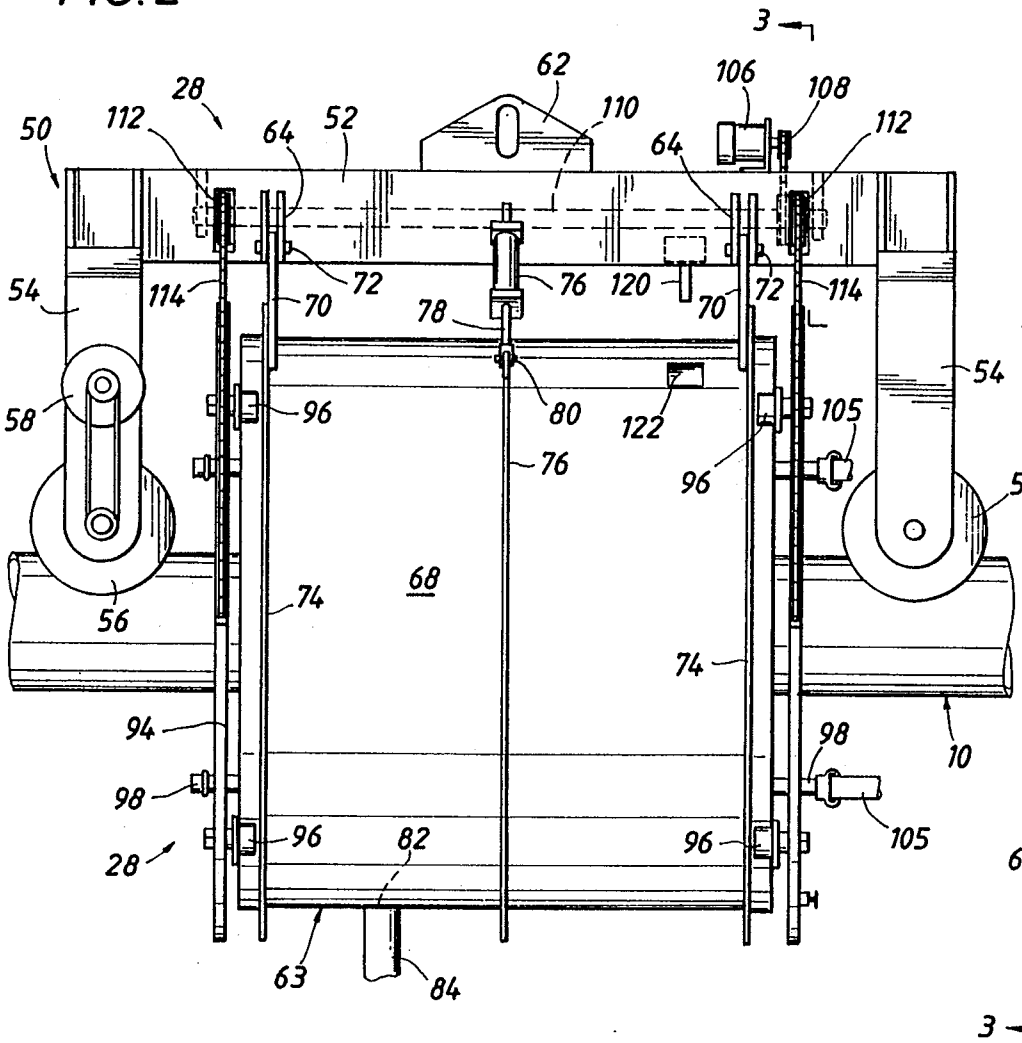
FIG. 2 is a side elevation of one embodiment of the apparatus in which an inner nozzle assembly is supported on an outer cylindrical housing for relative arcuate movement in an arcuate path concentric to the outer surface of the pipeline.

Referring now to the drawings for a better understanding of this invention and more particularly to FIG. 1, apparatus for treating the outer surface of a pipeline in accordance with this invention is illustrated such as cleaning or coating the pipeline. The pipeline is shown generally at 10 has been removed from ditch or trench 12 and is supported above the ground alongside ditch 12 for cleaning and for coating after being cleaned. Thereafter pipeline 10 is returned to ditch 12 and covered with soil or gravel. For supporting pipeline 10 above the ground, a front side boom tractor shown at 14 has a side boom 16 supporting a roller pipe support 18 mounted under pipe 10 and having rollers thereon for supporting the lower surface of pipe 10. A rear side boom tractor is shown at 20 having a side boom 22 and a roller pipe support 24 under pipe 10 for supporting the pipe.

Rear tractor 20 pulls a trailer or skid indicated generally at 26 alongside pipeline 10 which contains the supplies and power sources for operating a self propelled carriage shown generally at 28 mounted on pipe 10 behind roller support 24. Self propelled carriage 28 is supported on pipeline 10 for travel along pipeline 10 and includes a nozzle assembly for the discharge of pressurized cleaning material against the outer surface of pipeline 10 :for treating the outer surface of pipeline 10. For example, carriage 28 may be provided for the cleaning of pipeline 10 with the discharge of a pressurized liquid against the outer surface of pipeline 10. For this purpose, carriage 28 is adapted for the discharge of cleaning material from discharge nozzles in a high velocity stream for contacting the outer surface of pipeline 10.

The cleaning material may vary depending on the material to be removed from the outer surface of pipeline 10. At times, tar or a bituminous layer may be on the outer surface of the pipeline and pressurized water may be utilized. In the event rust scales are desired to be removed a grit material is normally discharged in a high velocity stream, such as air, to remove the rust scales and clean the outside of pipeline 10. If it is desired to remove rust scales, skid 26 would include, for example, an air compressor 32, a grit storage bin 34, a plurality of grit pots or containers 36 each having a separate discharge line 38 for supplying grit entrained in air to a discharge nozzle or carriage 28. A hand operated control valve 37 is provided between air compressor 32 and each grit pot 36. An air operated valve 39 is provided in each line 38 adjacent the associated grit pot 36 for control of the supply of grit or abrasive particles to carriage 28.

If desired to collect the scrap material, an enclosed housing may be provided and abrasive particles with removed foreign matter such as rust scales and the like may be returned from carriage 28 through return line 40 to a cleaner 42 for removal of the foreign matter and return of the abrasive particles to supply bin 34 for recycling. Under certain conditions such as the removal of a coating having asbestos material therein, it may be desirable to have the scrap material collected and removed to a disposal site. A hydraulic reservoir is shown at 44 on skid 26 and a hydraulic pump 45 supplies pressurized hydraulic fluid through line 46 to self propelled carriage 28. A suitable diesel engine 43 may be provided for driving hydraulic pump 45. A hydraulic fluid return line 47 is shown for return of fluid to reservoir 44. Skid 26 also includes a control area at 48 for an operator to control the operation including the control of air operated valves 39 and the energizing of hydraulic pump 45.

Referring now particularly to FIGS. 2–7, an embodiment of carriage 28 is illustrated. An upper support frame indicated at 50 includes upper horizontal frame members 52 having downwardly extending front and rear legs 54 on which anti-friction means comprising rollers 56 are mounted for supporting contact with the outer peripheral surface 58 of pipeline 10. A hydraulic motor 59 is provided for driving front rollers 56 for propelling carriage 28 along pipeline 10. A lifting eye 62 secured to upper support frame 50 is adapted for engagement by a suitable lift hook from a side boom or the like for positioning of carriage 28 onto pipeline 10 and removal of carriage 28 from pipeline 10. Support brackets 62 are secured to frame members 52 and extend downwardly therefrom.

It is desirable under certain conditions to provide an enclosed area about discharge nozzles which direct pressurized fluid against the outer periphery of pipeline 10 so that the removed waste or scrap material may be collected if desired. For that purpose, an outer cylindrical shell or housing generally indicated at 63 and having open ends is provided. Housing 63 comprises two side sections or halves 66 and 68. Each semi-circular housing section 66, 68 has upper extensions 70 secured thereto pivotally connected at 72 to brackets as shown particularly in FIG. 5. Housing 63 has an angle member 74 along each end thereof and an intermediate reinforcing rib 76. For pivoting of housing sections 66, 68 about pipeline 10, a hydraulic fluid cylinder 76 for each section 66, 68 is pivotally mounted at one end 78 to support frame 52. Piston rod 79 from the other end of cylinder 76 is pivotally mounted at 80 to reinforcing rib 76. Hydraulic fluid is supplied to cylinders 76 for actuation thereof. A bottom discharge opening may be provided at 82 for removal of scrap material and the like from housing 63 through a conduit 84 for return to a collection member for separate disposal or return to skid 26 through line 40 for cleaning or recycling. In some instances it may be desirable to deposit the scrap material alongside the trench and if so, conduit 84 may be removed. While the arrangements shown in FIG. 1 show the use of entrained material, such as grit, in the pressurized liquid, it may be desirable in some instances to utilize only pressurized liquid, such as pressurized water.

As shown particularly in FIG. 5, an inner nozzle assembly is generally indicated at 86 and is mounted for arcuate movement relative to outer housing 63 in a path concentric to outer periphery 58 of pipeline 10. Inner nozzle assembly 86 comprises two assembly sections or halves 88, 90 having lower ends latched to each other at 92 when in an assembled position about pipeline 10 for movement along the pipeline. Each nozzle assembly section 88, 90 includes a pair of arcuate members 94 on opposite ends thereof having rollers 96 mounted thereon and supported on angles 74 of housing 63 for arcuate movement in a direction concentric to outer periphery 58 of pipeline 10. A plurality of arcuate plates or rings 100 in spaced parallel relation to each other are mounted between outer surface 58 of pipeline 10 and the inner surface of housing 63. Elastomeric annular seals 102 are mounted on the inner and outer marginal portions of rings 100 for engaging the adjacent surfaces of pipeline 10 and housing 63 in sealing relation thereto.

Tubular members or fluid conduits 98 extend through suitable openings in arcuate members 94 and 100 and are secured thereto for connecting members 94 and 100 together for oscillating movement relative to outer cylindrical shell 63. A discharge nozzle 104 is secured to each tubular member 98 and a flexible hose 105 is detachably connected to each tubular member 98 for supplying pressurized fluid thereto for discharge from discharge nozzles 104. Drive means are provided for oscillating nozzle assembly 86 in an arcuate path relative to outer cylindrical housing 63 including a reversible hydraulic drive motor 106 having a drive sprocket 108 for rotating a countershaft 110 having a sprocket wheel 112 on each end thereof. A sprocket chain 114 extends from each sprocket wheel 112 and has opposed ends thereof anchored at 116 an associated arcuate ring 94. Rotation of reversible motor 106 in opposite directions oscillates inner nozzle assembly 86 relative to outer housing 63 and pipeline 10 in an arcuate direction concentric to outer surface 58 of pipeline 10 with supporting rollers 96 riding along housing 63.

To effect reversal of hydraulic drive motor 106, a trip valve 118 is mounted on frame 52 and includes a pair of fingers 120, 121 adapted to be contacted by prongs 122 on nozzle assembly sections 88 and 90. Upon rotation of nozzle assembly 86 in a clockwise direction, finger 120 is contacted by prong 122 on nozzle assembly section 88 to trip valve 118. In a counterclockwise direction, prong 122 on nozzle assembly section 68 contacts finger 121 for tripping valve 118. The location of prong 122 may be adjusted by slide 123 along rod 125 as shown in FIG. 6. As shown particularly in FIG. 7, hydraulic pump 124 supplies hydraulic fluid from reservoir 127 through line 126 and shuttle valve 128 to line 130 and motor 106 to rotate motor 106 in a counterclockwise direction. Pump 124 and reservoir 127 are normally mounted on skid 26. Fluid from line 126 through trip valve 118 holds shuttle valve in the position shown in FIG. 7 with fluid being supplied through line 129. Fluid is returned to reservoir 127 through line 132. Upon tripping of trip valve 118, fluid is supplied through line 131 to shuttle valve 128 to move shuttle valve to an opposite position to reverse the flow of fluid to reversible motor 106 with fluid being supplied to motor 106 through line 132 and exhausted from line 130. Fluid from shuttle valve 128 is exhausted through line 134 to reservoir 127.

Figure 9:
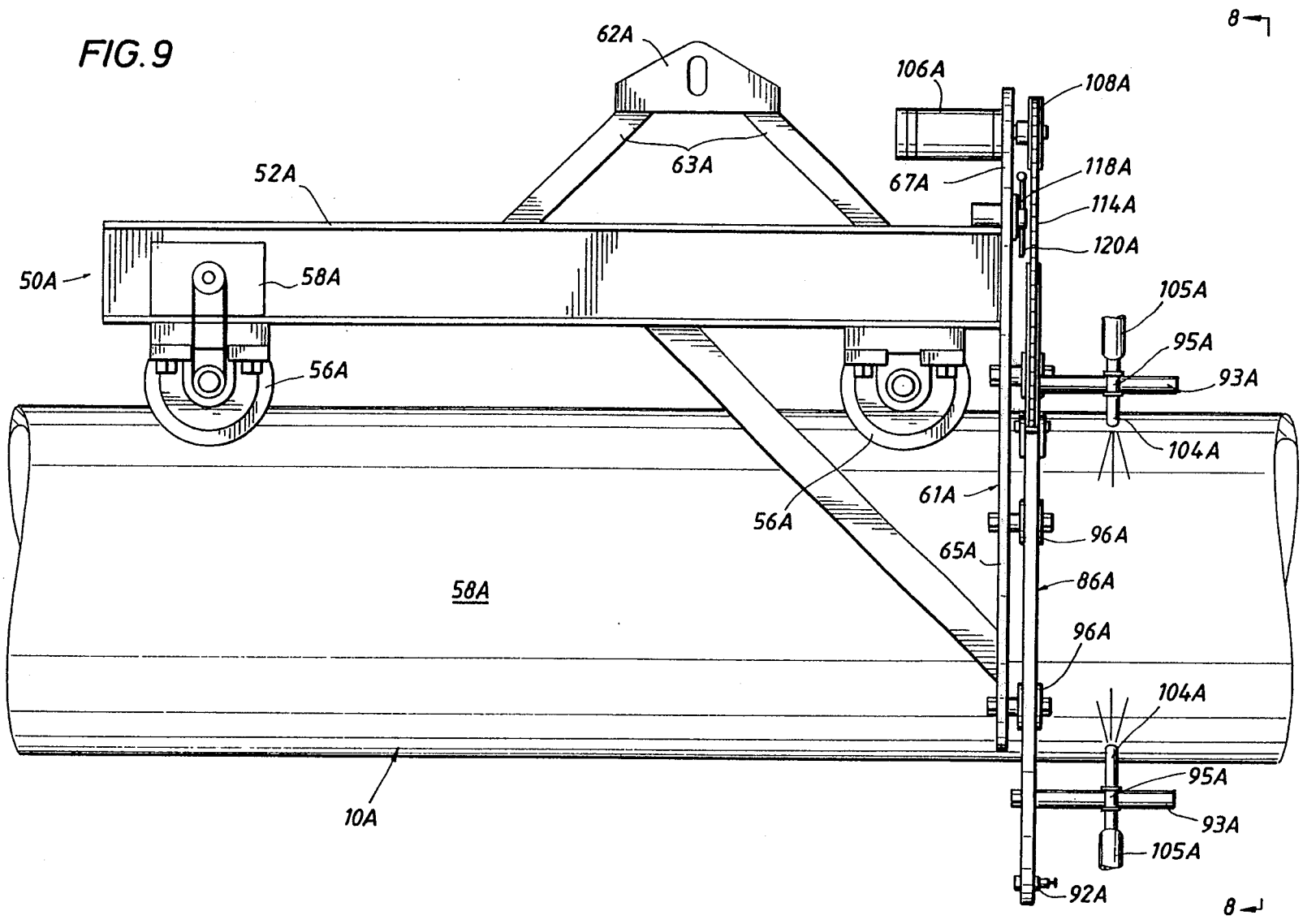
FIG. 9 is a side elevation of the apparatus shown in FIG. 8 showing the nozzle assembly supported on the yoke and extending around the pipeline.

Referring now to FIGS. 8–10, a separate embodiment of the invention is shown in which a carriage generally indicated at 28A is provided including an upper support frame generally indicated at 50A and including longitudinal extending frame members 52A with supporting rollers 56A thereon supported on pipe 10A. An inverted U-shaped yoke generally indicated at 61A is secured to a rear end of frame 50A. An upper lift eye 62A is secured to frame members 63A extending upwardly frame members 52A. A hydraulic motor 58A is provided for driving front roller 56A.

Yoke 61A has a pair of downwardly extending opposed arms 65A and 66A and an upper extending support plate 67A. Arms 65A, 66A have lower ends 68A which are spaced frown each other a distance greater than the diameter of pipeline 10A so that yoke 61A may easily be positioned alongside pipeline 10A as shown in FIG. 10 with arms 65A, 66A being fixed to upper support frame 50A. Yoke 61A has a plurality of grooved rollers 96A thereon spaced in an arcuate path concentric to the outer periphery 58A of pipeline 10A.

A nozzle assembly generally indicated at 86A is mounted for relative oscillating movement on rollers 96A along an arcuate path concentric to outer surface 58A of pipeline 10A. Nozzle assembly 86A forms an inner circular opening receiving pipeline 10A when in operable position about pipeline 10A. Nozzle assembly 86A includes an upper supporting section generally indicated at 87A having a pair of hinges 88A on its lower ends mounting a pair of side section or arms 89A for pivotal movement about pivot 91A on hinges 88A so that arms 89A may be pivoted to an open direction as shown in FIG. 10 for positioning about pipeline 10A and latching by a latch 92A which includes a spring mounted plunger pin on one arm 89A engaging an opening in the other arm 89A.

A plurality of nozzle mounting pins 93A extend laterally from nozzle assembly 86A and each has a clamp 95A mounted thereon carrying a discharge nozzle 104A connected to a flexible hose 105A for the supply of a pressurized fluid to discharge nozzle 104A for cleaning the outer surface 58A of pipeline 10A.

For oscillating nozzle assembly 86A relative to yoke 61A in an arcuate path concentric to the outer periphery of pipeline 10A, a reversible motor 106A is mounted on upper support plate 67A of yoke 61A for driving of sprocket wheel 108A. Sprocket chain 114A has its ends secured to hinges 88A for oscillation of nozzle assembly 86A relative to yoke 61A. A trip valve 118A is mounted on support plate 67A and prongs 122A engage fingers on trip valve 118A as in the embodiment of FIGS. 2–7 and as shown particularly in FIG. 7 for operation. Prongs 122A may be adjusted to vary the stroke of nozzle assembly 68A.

As shown in FIG. 10, for positioning carriage 28A on pipeline 10A, yoke 61A is lowered by a lift hook engaging lift eye 62A onto the upper peripheral surface 58A of pipeline 10A with rollers 56A engaging pipeline 10A as shown in FIG. 10. Then, arms 89A of nozzle assembly 86A are swung inwardly about pipeline 10A and latch 92A is engaged to hold side section or arms 89A about pipeline 10A. For small diameter pipeline 10A, arms 89A may be manually swung together and latched. However, for large diameter pipeline 10A, it may be desirable to provide a power cylinder for pivotal movement of side sections 89A.

Figure 12:
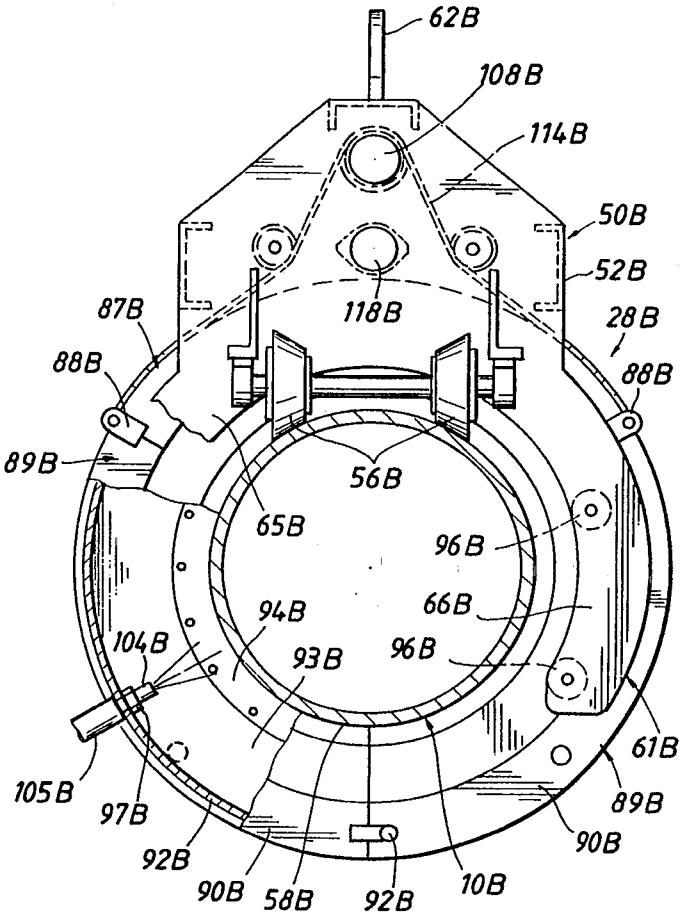
FIG. 12 is an end elevation of the embodiment shown in FIG. 11.
Figure 11:
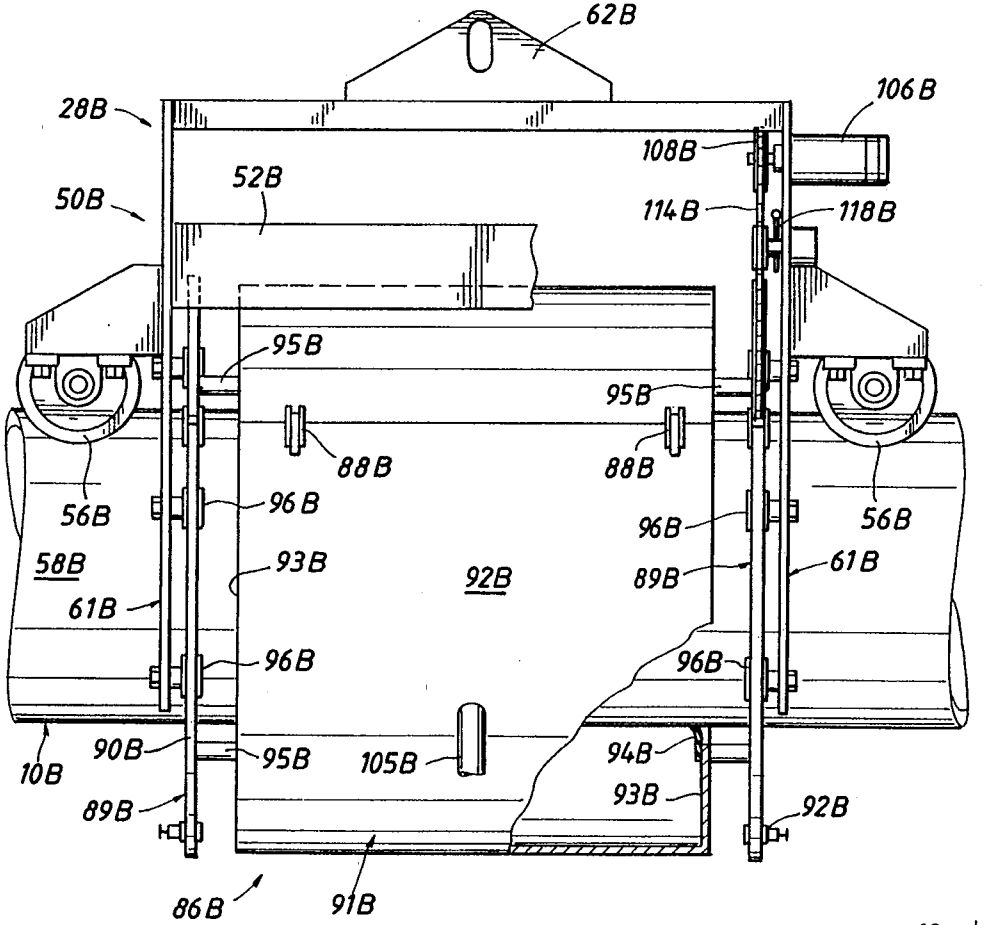
FIG. 11 is a side elevation of a further embodiment in which an enclosed housing is mounted for oscillation on a pair of U-shaped yokes.

Referring now to FIGS. 11 and 12, a further embodiment of this invention is illustrated in which a carriage 28B has an upper support frame 50B and longitudinal extending frame members 52B supporting rollers 56B for movement along the outer surface 58B of pipeline 10B. A pair of inverted U-shaped yokes 61B are secured to opposed ends of support frame 50B. Each yoke 61B has a pair of arms 65B and 66B for fitting around pipeline 10B and spaced from each other a distance greater than the diameter of pipeline 10B. Grooved rollers 96B are secured to the inner surface of each yoke 61B.

A nozzle assembly 86B is mounted between yokes 61B on rollers 96B for oscillation. Nozzle assembly 86B comprises an upper support section 87B having hinges 88B on its lower ends with side sections 89B mounted for pivotal movement on hinges 88B for fitting around pipeline 10B. Side sections 89B when in latched position about pipeline 10B by latches 72B as shown in FIGS. 11 and 12 include an end arcuate plate member 90B supporting an enclosed housing shown at 91B about pipeline 10B. Enclosed housing 91B includes an outer cylindrical wall 92B and end walls 93B. End walls 93B include an opening having a elastomeric seal 94B extending about the opening and contacting the outer periphery 58B of pipeline 10B as shown particularly in FIG. 12. Mounting rods 95B connect end walls 93B to end plates 90B for oscillating movement of housing 91B with end plates 90B on rollers 96B. For mounting discharge nozzles 104B, openings in cylindrical wall 92B receive a sleeve therein designated at 97B. Nozzles 104B are secured within sleeves 97B and have flexible hoses 105B connected thereto for the supply of pressurized fluid for cleaning outer surface 58B of pipeline 10B. Nozzles 104B are spaced at intervals of 90 degrees, for example, about the periphery of pipeline 10A.

Nozzle assembly 86B including arcuate side sections 89B and housing 91B is mounted on rollers 96B for oscillation relative to supporting U-shaped yokes 61B. For this purpose, a reversible motor 106B has a drive sprocket wheel 108B and a sprocket chain 114B extending therefrom and having its ends secured to arcuate plates 89B. Reversible motor 106B is actuated in a manner similar to reversible motor 106 shown in the embodiment of FIGS. 2–7.

It is desirable under certain conditions to treat the outer surface of a pipeline while the pipeline remains in service for the transport of fluid ladings. Under these conditions, the pipeline while remaining in the ditch or trench may be supported by wooden timbers or supports shown at 35C in FIGS. 13 and 14 after soil or material beneath pipeline 10C has been removed. The cleaning apparatus 28C is then positioned about the pipeline 10C between spaced timbers 35C for movement along the pipeline. Stressing of the pipeline during the cleaning operation may occur from the weight of cleaning apparatus 28C on pipeline 10C and it is desirable to mount the cleaning apparatus about the pipeline in a cushioned manner to offset the weight of cleaning apparatus 35C.

Figure 13:
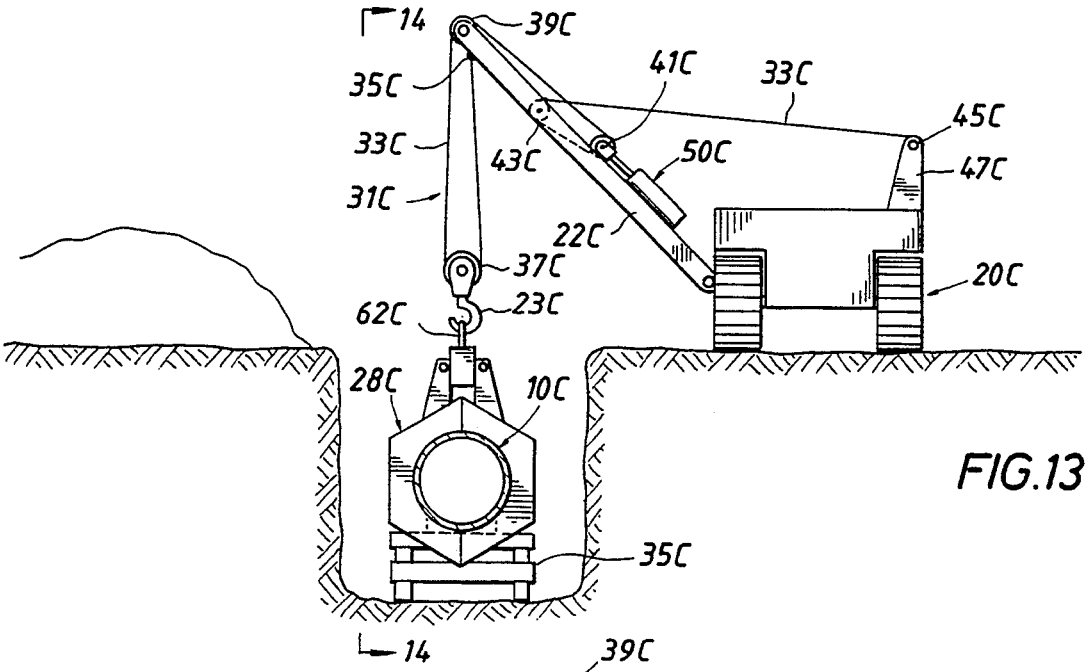
FIG. 13 is an end elevation, partly schematic, of lift means for supporting the apparatus shown in FIGS. 2–7 while positioned about a pipeline within a ditch for cleaning the pipeline with a boom supporting a lift hook for the cleaning apparatus in a cushioned relation.
Figure 14:
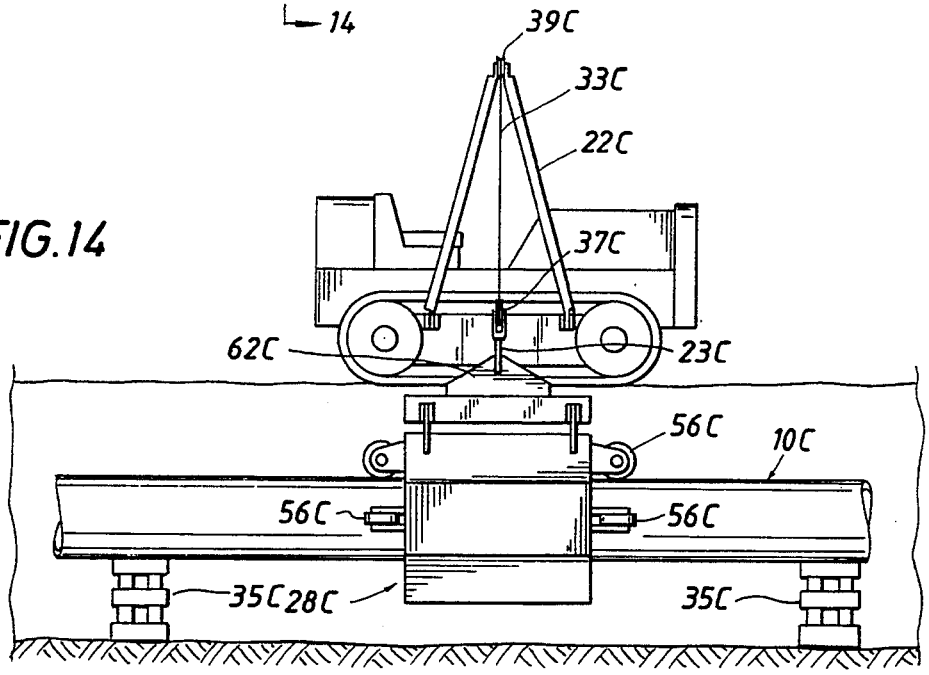
FIG. 14 is taken generally along line 14—14 of FIG. 13.
Figure 15:
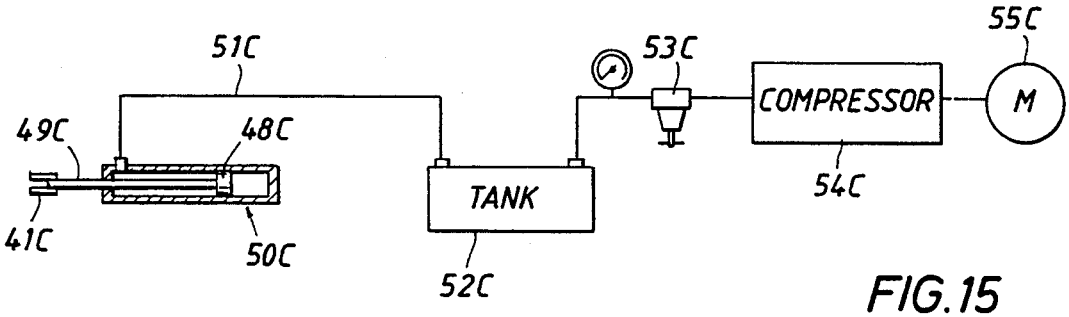
FIG. 15 is a schematic of the pneumatic system for cushioning the lift hook supporting the cleaning apparatus shown in FIGS. 13 and 14.

As shown in FIGS. 13–15 a side boom tractor or track vehicle indicated generally at 20C has a side boom 22C thereon supporting a lift hook 23C engaging a lift eye 62C for cleaning apparatus or carriage 28C. Carriage 28C is supported for travel along pipeline 10C and lift hook 23C is adapted for lifting and supporting carriage 28C for movement along pipeline 10C. A pulley and cable arrangement is shown generally at 31C and includes a cable 33C having one end anchored at 35C to side boom 22C and extending about pulley 37C for lift hook 23C, then about pulley 39C on the end of side boom 22C, and next about pulley 41C for a cushioned device indicated generally at 43C. Cable 33C then extends about pulley 43C on boom 22C and has its end anchored at 45C to anchor member 47C on tractor 20C.

Cushion device or cylinder 50C particularly as shown in FIG. 15 includes a pressure fluid position piston 48C having piston rod 49C mounting pulley 41C which receives cable 33C. Piston 48C is slidably positioned within cylinder 50C and air under pressure is supplied through line 51C from an air reservoir shown at 52C. A pressure regulator valve shown at 53C is provided for controlling the movement of piston 48C at a predetermined fluid pressure maintained by the setting of regulator valve 53C thereby providing a variable cushion rate for cushion device 50C. The load suspended by lift hook 23C will determine the pressure setting of regulator valve 53C with the entrapped air in cylinder 50C acting on piston 49C providing an air cushion spring for lift hook 23C and carriage 28C. Air is supplied by a suitable air compressor 54C driven by motor 55C. During movement of carriage 28C along pipeline 10C, piston 48C will be continually moving back and forth under the setting of regulator valve 53C to offset the weight of carriage 28C as it moves along pipeline 10C thereby to minimize stresses in pipeline 10C resulting from the weight of carriage 28C and movement of carriage 28C along pipeline 10C during the cleaning operation.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A carriage adapted to be supported on a pipeline for longitudinal movement along the pipeline to treat the outer surface of the pipeline; said carriage comprising:

an upper support frame having anti-friction means for supporting contact with the upper surface of the pipe and a pair of inverted U-shaped yokes on opposed ends of said frame for fitting alongside opposite sides of the pipeline in spaced relation thereto;

said U-shaped yokes being fixed to said upper support frame with each yoke having a pair of downwardly extending arms fitting alongside opposite sides of said pipeline, said arms having lower ends spaced from each other a distance greater than the diameter of said pipeline;

a nozzle assembly supported from said upper support frame and including a generally cylindrical housing mounted for pivotal movement into an operable position about said pipeline;

rollers mounted between said nozzle assembly and said yokes for oscillating movement of said nozzle assembly and housing relative to said yokes;

a plurality of fluid discharge nozzles mounted on said housing and spaced about the outer periphery of said pipeline; and drive means on said support frame operatively connected to said nozzle assembly for oscillating said nozzle assembly and housing thereon relative to said yokes in an arcuate direction concentric to the outer periphery of said pipeline.

2. A carriage as set forth in claim 1 wherein said nozzle assembly includes arcuate members secured to said housing, said rollers being mounted between said yokes and said arcuate members for supporting said housing for oscillation.

3. A carriage adapted to be supported on the outer surface of a pipeline for longitudinal movement along the pipeline to treat the outer surface of the pipeline; said carriage comprising:

an upper support frame having anti-friction means for contacting the outer surface of a pipeline;

an outer cylindrical housing supported from said upper support frame and secured to said upper support frame when in concentric operable relation about said pipeline;

an inner nozzle assembly mounted within said outer cylindrical housing for arcuate movement relative to said outer cylindrical housing in a direction concentric to the outer surface of said pipeline;

additional anti-friction means between said inner nozzle assembly and said outer cylindrical housing mounting said inner nozzle assembly for arcuate movement relative to said outer cylindrical housing in a direction concentric to the outer surface of said pipeline; and a plurality of discharge nozzles on said inner nozzle assembly spaced about the outer periphery of said pipeline for the discharge of pressurized treating material against the outer surface of the pipeline; and drive means on said support frame to oscillate said inner nozzle assembly relative to said outer cylindrical housing in an arcuate path concentric to the outer periphery of said pipeline; said inner nozzle assembly comprising a plurality of parallel annular members in concentric relation about said pipeline between said outer cylindrical housing and said pipeline, and a plurality of tubular members secured between said parallel annular members having said discharge nozzles mounted thereon.

4. A carriage as set forth in claim 3 wherein said anti-friction means comprise a plurality of rollers spaced about the outer periphery of said pipeline.

5. A carriage as set forth in claim 3 wherein flexible hoses are connected to said tubular members for the supply of pressurized treating material.

6. A carriage as set forth in claim 5 wherein said drive means comprises a reversible fluid motor and a sprocket chain between said fluid motor and said nozzle assembly for oscillating said nozzle assembly.

7. A carriage as set forth in claim 6 wherein actuating means are contacted at the ends of an oscillating stroke to reverse the direction of rotation of said reversible motor.

8. A carriage adapted to be supported on the outer surface of a pipeline for longitudinal movement along the pipeline to treat the outer surface of the pipeline; said carriage comprising:

support means having anti-friction means for contacting said outer surface and an outer cylindrical housing in concentric relation about the pipeline;

an inner nozzle assembly mounted within said outer cylindrical housing adjacent said pipeline for arcuate movement relative to said outer cylindrical housing in a direction concentric to the outer surface of said pipeline and including at least one arcuate nozzle support member between said pipeline and said outer cylindrical housing in concentric relation thereto;

a plurality of discharge nozzles on said nozzle support member spaced about the outer surface of the pipeline for the discharge of pressurized treating material against the outer surface of the pipeline;

drive means to oscillate said inner nozzle assembly and nozzles thereon relative to said outer cylindrical housing in an arcuate path concentric to the outer peripheral surface of said pipeline;

a plurality of spaced generally parallel arcuate nozzle support members mounted between said pipeline and said cylindrical housing; and a plurality of tubular members secured between said parallel nozzle support members having said discharge nozzles mounted thereon.

9. A carriage adapted to be supported on the outer surface of a pipeline for longitudinal movement along the pipeline to treat the outer surface of the pipeline; said carriage comprising:

support means having anti-friction means for contacting said outer surface and an outer cylindrical housing in concentric relation about the pipeline;

an inner nozzle assembly mounted within said outer cylindrical housing adjacent said pipeline for arcuate movement relative to said outer cylindrical housing in a direction concentric to the outer surface of said pipeline and including at least one arcuate nozzle support member between said pipeline and said outer cylindrical housing in concentric relation thereto;

a plurality of discharge nozzles on said nozzle support member spaced about the outer surface of the pipeline for the discharge of pressurized treating material against the outer surface of the pipeline; and drive means to oscillate said inner nozzle assembly and nozzles thereon relative to said outer cylindrical housing in an arcuate path concentric to the outer peripheral surface of said pipeline; said drive means being mounted on said support means and comprising a reversible motor operatively connected to said inner nozzle assembly for oscillating said nozzle assembly relative to said outer cylindrical housing.

10. A carriage adapted to be supported on the upper surface of a pipeline for longitudinal movement along the pipeline to treat the outer surface of the pipeline; said carriage comprising:

an upper support frame having anti-friction means for supporting contact with the upper surface of the pipe and an inverted U-shaped yoke for fitting alongside opposite sides of the pipeline in spaced relation thereto;

said U-shaped yoke being fixed to said upper support frame and having a pair of downwardly extending arms fitting alongside opposite sides of said pipeline, said arms having lower ends spaced from each other a distance greater than the diameter of said pipeline;

a nozzle assembly supported from said upper support frame and including a pair of side sections mounted for pivotal movement into an operable position about said pipeline;

anti-friction means mounted between said nozzle assembly and said yoke for movement of said nozzle assembly relative to said yoke;

a plurality of fluid discharge nozzles mounted on said side sections and spaced about the outer periphery of said pipeline; and drive means on said support frame operatively connected to said nozzle assembly for oscillating said nozzle assembly and nozzles thereon relative to said yoke in an arcuate direction concentric to the outer periphery of said pipeline;

said nozzle assembly including an enclosed housing extending about said pipe comprising a cylindrical outer member and opposed end members; said nozzle assembly further including arcuate members secured to said opposed end members of said housing, said anti-friction means between said nozzle assembly and said yoke comprising rollers between said yoke and said arcuate members mounting said housing for oscillating movement in a path concentric to the outer peripheral surface of said pipeline.

11. A carriage adapted to be supported on the upper surface of a pipeline for longitudinal movement along the pipeline to treat the outer surface of the pipeline; said carriage comprising:

an upper support frame having anti-friction means for supporting contact with the upper surface of the pipe and a pair of inverted U-shaped yokes mounted on opposed ends of said upper support frame for fitting alongside opposite sides of the pipeline in spaced relation thereto;

said U-shaped yokes being fixed to said upper support frame and having pairs of downwardly extending arms fitting alongside opposite sides of said pipeline, said arms having lower ends spaced from each other a distance greater than the diameter of said pipeline;

a nozzle assembly supported from said upper support frame and including a pair of side sections mounted for pivotal movement into an operable position about said pipeline, said side sections including a cylindrical housing between said yokes;

anti-friction means mounted between said nozzle assembly and said yokes for movement of said nozzle assembly relative to said yokes;

a plurality of fluid discharge nozzles mounted on said side sections and spaced about the outer periphery of said pipeline; and drive means on said support frame operatively connected to said nozzle assembly for oscillating said nozzle assembly and nozzles thereon relative to said yokes in an arcuate direction concentric to the outer periphery of said pipeline.

12. A carriage as set forth in claim 11 wherein said housing has side portions thereof mounted for pivotal movement with said side sections.

* * * * *